US007500580B2

(12) United States Patent
Hawkins

(10) Patent No.: US 7,500,580 B2
(45) Date of Patent: Mar. 10, 2009

(54) PAINT BRUSH HOLDER FOR A PAINT CAN

(76) Inventor: Shannon W. Hawkins, 16275 S. Hunter, Olathe, KS (US) 66062

( * ) Notice: Subject to any disclaimer, the term of this patent is extended or adjusted under 35 U.S.C. 154(b) by 477 days.

(21) Appl. No.: 10/904,867

(22) Filed: Dec. 1, 2004

(65) Prior Publication Data

US 2006/0113310 A1 Jun. 1, 2006

(51) Int. Cl.
*B65D 3/26* (2006.01)

(52) U.S. Cl. ..... 220/736

(58) Field of Classification Search ..... 220/699, 220/700, 701, 698, 697, 695, 735, 736; 211/65
See application file for complete search history.

(56) References Cited

U.S. PATENT DOCUMENTS

| | | | | | |
|---|---|---|---|---|---|
| 955,646 | A * | 4/1910 | Jorey | 211/65 |
| 2,023,399 | A * | 12/1935 | Bullard | 220/696 |
| 2,703,652 | A * | 3/1955 | Dominik | 211/65 |
| 2,707,052 | A * | 4/1955 | Brown | 211/65 |
| 2,814,824 | A * | 12/1957 | Woodward | 15/257.05 |
| 3,406,812 | A * | 10/1968 | Henry | 401/118 |
| 4,101,046 | A * | 7/1978 | Puntillo | 220/697 |
| 4,773,544 | A * | 9/1988 | McCarthy | 211/69.1 |
| 5,097,965 | A * | 3/1992 | Fehr | 211/65 |
| 5,253,768 | A * | 10/1993 | Traversa et al. | 211/65 |
| 5,329,663 | A * | 7/1994 | Council | 15/143.1 |
| 6,419,194 | B1 * | 7/2002 | LoSacco et al. | 248/113 |
| 6,609,685 | B1 * | 8/2003 | Lamont | 248/110 |
| 6,616,110 | B1 | 9/2003 | McIntee | |
| 2002/0096525 | A1 * | 7/2002 | Bertoldo et al. | 220/544 |
| 2005/0161460 | A1 * | 7/2005 | Depasquale et al. | 220/736 |
| 2006/0037920 | A1 * | 2/2006 | Baranya | 211/70.6 |

OTHER PUBLICATIONS

Heavens, Allen J.. "DIY's 'Workshop' is Good for Basics". Chicago Tribune, Jul. 16, 2004, p. 8, Full Text Line 25.*

* cited by examiner

*Primary Examiner*—Anthony D Stashick
*Assistant Examiner*—Robert J Hicks
(74) *Attorney, Agent, or Firm*—Hovey Williams LLP

(57) ABSTRACT

The paint brush holder includes a body removably attachable to a paint container. A gripping element is supported on the body so as to be positioned over the open top of the container. The gripping element releasably grips the handle portion of the paint brush along the length thereof, so that the position of the paint brush is vertically adjustable.

28 Claims, 5 Drawing Sheets

PAINT BRUSH HOLDER FOR A PAINT CAN

BACKGROUND OF THE INVENTION

1. Field of the Invention

The present invention relates generally to painting equipment. More particularly, the present invention concerns a device for holding a paint brush on a paint container so that the paint applicator is positioned within the container at a vertically adjustable location.

2. Discussion of Prior Art

Various types of containers are used in the painting industry. In particular, containers are used by painters (including commercial and the so-called "DIY" painters) for various reasons, including storing paint, containing paint during painting applications, and holding cleaning fluids used to clean painting tools. Those of ordinary skill in the industry will appreciate that it is often desirable to support a painting tool, such as a paint brush, within a container. For example, during painting operations, the painting tool is often temporarily placed within the container between paint applications. Painting tools are often stored within a container, particularly by commercial painters, for longer periods of time (e.g., overnight). Yet further, painting tools are often soaked in cleaning fluid contained within a container.

However, placement of the painting tool within the container can be problematic. For example, if the paint applicator of the tool (e.g., the bristles of a paint brush) rest against the bottom of the container, the applicator can be permanently damaged. Furthermore, the fluid level within the container is variable and it is undesirable to substantially submerge the applicator or any portion of the handle. Although paint brush holders have been developed to suspend the bristle head within the container above the bottom of the container, such conventional holders have limitations. For example, conventional brush holders often fail to securely attach to the container or support the painting tool, such that inadvertent displacement of the tool from or within the container is likely. In addition, conventional brush holder designs are typically dedicated to a single container configuration; that is, a conventional brush holder is usually unable to be used with variously configured containers. Furthermore, traditional brush holders fail to accommodate for varying fluid levels within the container.

SUMMARY OF THE INVENTION

A first aspect of the present invention concerns a paint brush holder for supporting a paint brush on an open top paint container, wherein the paint brush has an elongated handle and a paint applicator projecting from one end of the handle. The paint brush holder includes a body removably attachable to the paint container. The holder also includes a handle gripping element fixed to the body so as to be disposed in lateral alignment with the open top of the container when the body is attached to the container. The gripping element is configured to releasably grip the handle of the paint brush along the length of the handle, with the applicator thereby being moveably located within the paint container at a position that is vertically adjustable relative to the open top of the container.

Another aspect of the present invention concerns a somewhat similarly constructed paint brush holder in combination with the paint container and paint brush.

Yet another aspect of the present invention concerns a method of adjustably supporting a paint brush on a paint container. The method comprises the steps of attaching a paint brush holder to the paint container, positioning the applicator of the paint brush within the container, releasably securing the paint brush to the brush holder so that the applicator is located within the paint container at a first position, and vertically repositioning the paint brush so that the applicator is located within the paint container at a second position that is vertically spaced from the first position. The repositioning step involves the step of releasably resecuring the paint brush to the brush holder.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

DETAILED DESCRIPTION OF THE PREFERRED EMBODIMENTS

Figure 3:
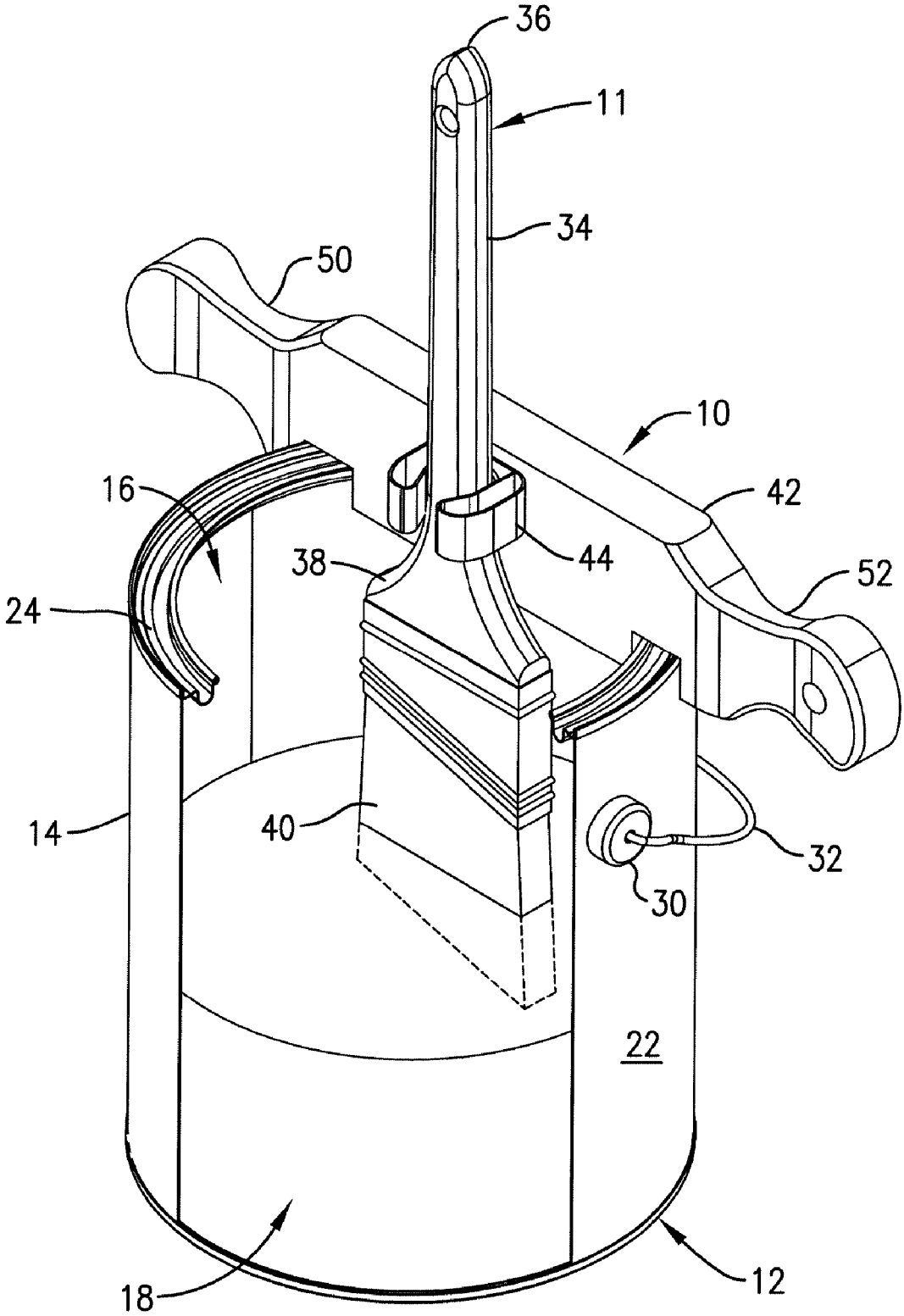
FIG. 3 is a perspective view of the paint brush holder mounted on a paint can and supporting a paint brush so that the bristles of the applicator are located partially within a fluid contained within the can.
Figure 4:
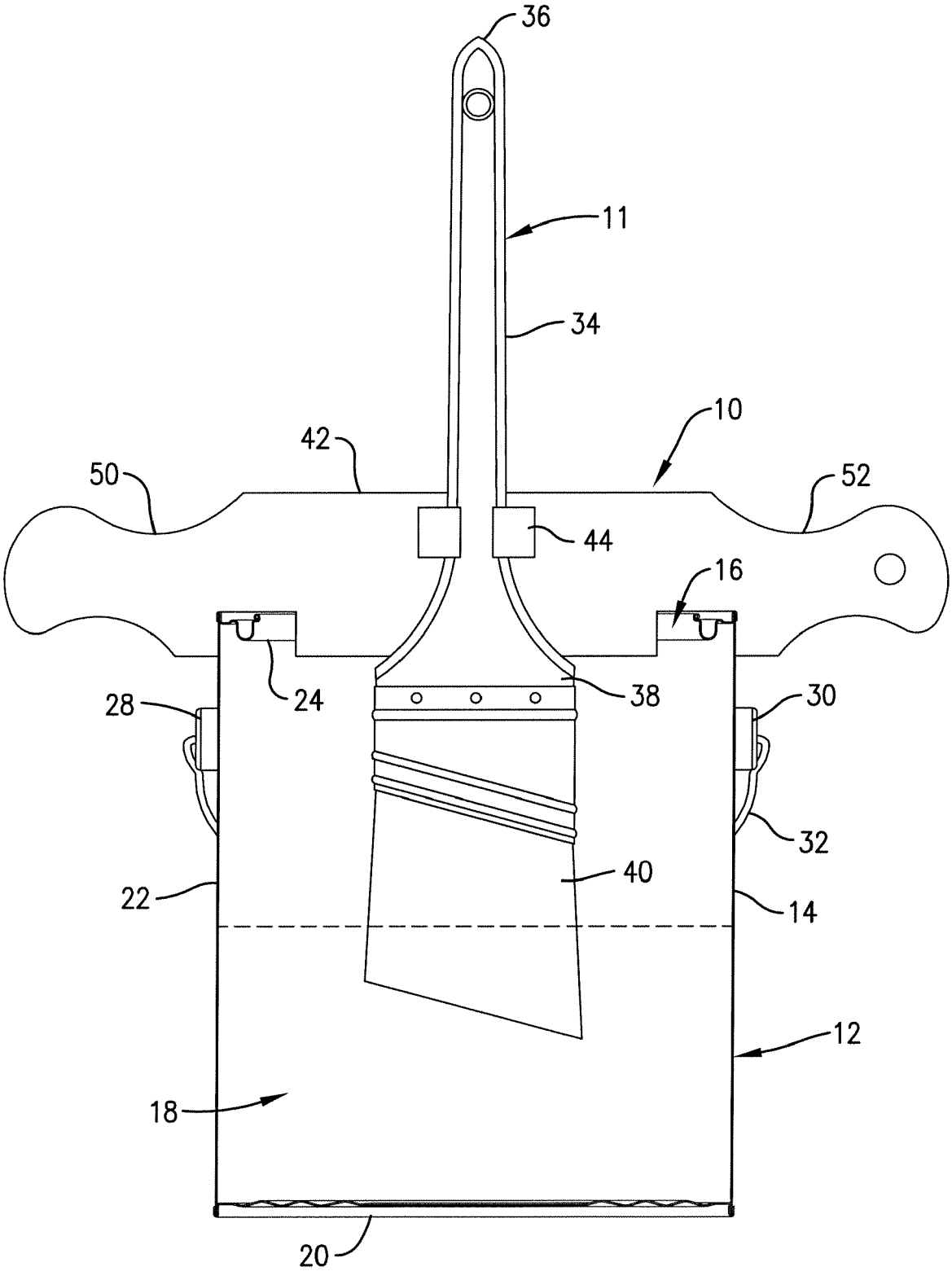
FIG. 4 is a vertical sectional view of the combination depicted in FIG. 3.
Figure 5:
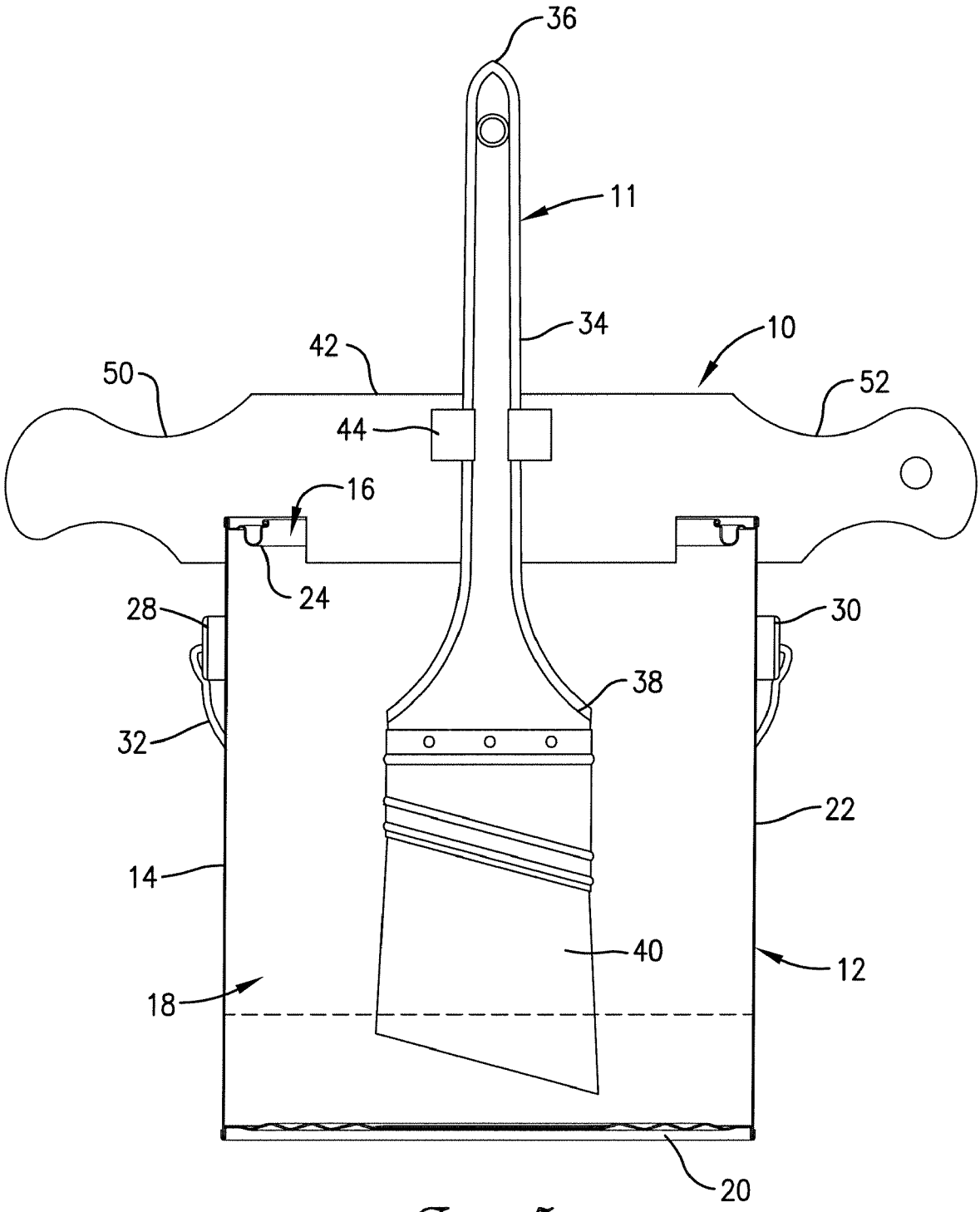
FIG. 5 is a vertical sectional view of the combination similar to FIG. 4, but depicting a lower fluid level and the paint brush appropriately repositioned downwardly within the paint can.

As perhaps best shown in FIGS. 3-5, the paint brush holder 10 selected for illustration is depicted holding a traditional paint brush 11 on a standard one-gallon metal paint can 12. However, as will be apparent from the following description, the principles of the present invention are applicable to other variously sized, shaped, and manufactured containers.

With the foregoing caveat in mind, the can 12 includes wall structure 14 defining an open top 16 and an internal fluid-containing chamber 18 extending downwardly from the open top 16. More particularly, the wall structure includes a circular-shaped bottom wall 20 (see FIGS. 4 and 5) and a cylindrical side wall 22 extending upwardly from the bottom wall 20 to the top 16. Again, the illustrated can 12 is a traditional one-gallon paint can and consequently present a diameter of approximately six and one-half inches and a height of approximately seven and three-quarter inches. A rim 24 circumscribing the top of the side wall 22 defines the open top 16. Furthermore, the rim 24 has the conventional configuration for sealingly engaging the lid 26 (see FIG. 6). As is customary, the rim 24 extends approximately one-half inch inwardly from the side wall. A pair of diametrically opposed mounting bosses 28 and 30 are provided on the side wall 22 to support a swingable handle 32.

Again, it is entirely within the ambit of the present invention to utilize alternative containers, including containers having different sizes and shapes and being formed of different materials (e.g., synthetic materials). For example, it has been determined that the illustrated brush holder 10, when lengthened, is also suitable for use with standard five-gallon plastic buckets. Furthermore, the present invention also contemplates a brush holder used in connection with a polygonal-shaped container (e.g., a square shaped container). Yet further, containers provided with other features not shown in the drawing figures, such as liners, are also within the principles of the present invention.

Similar to the paint can 12, the illustrated paint brush 11 has a conventional design. Particularly, the brush 11 has an elongated handle 34 presenting a proximal end 36 and a distal end 38. Preferably, the handle 34 is generally straight (i.e., presents a substantially unchanging cross-section dimension and shape) along a substantial portion thereof, although such a construction is not necessary. A paint applicator 40, which in the illustrated embodiment consists of a plurality of bristles, extends from the distal end 38 of the handle 34.

Those ordinarily skilled in the industry will appreciate that the principles of the present invention are also applicable to other types of painting tools, although the preferably has an elongated handle and a paint applicator projecting from one end of the handle. For example, the principles of the present invention are equally applicable to a tool having a sponge or pad attached to one end of the handle. Other types of elongated handles could alternatively be used, as long as the handle can be gripped along its length so that the applicator is retained at a vertically adjustable position within the can. In view of the foregoing, the term "paint brush" as used herein shall be interpreted to mean the illustrated brush, as well as the possible alternatives contemplated herein.

Figure 1:
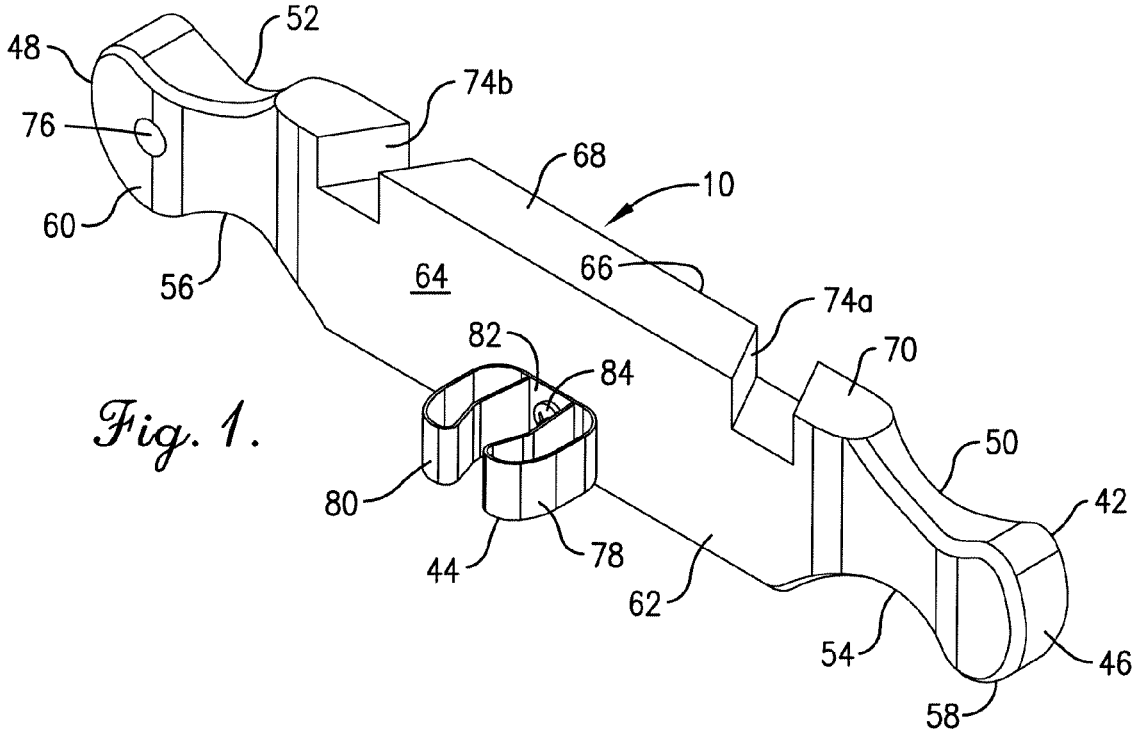
FIG. 1 is a bottom perspective view of a paint brush holder constructed in accordance with the principles of an embodiment of the present invention.
Figure 2:
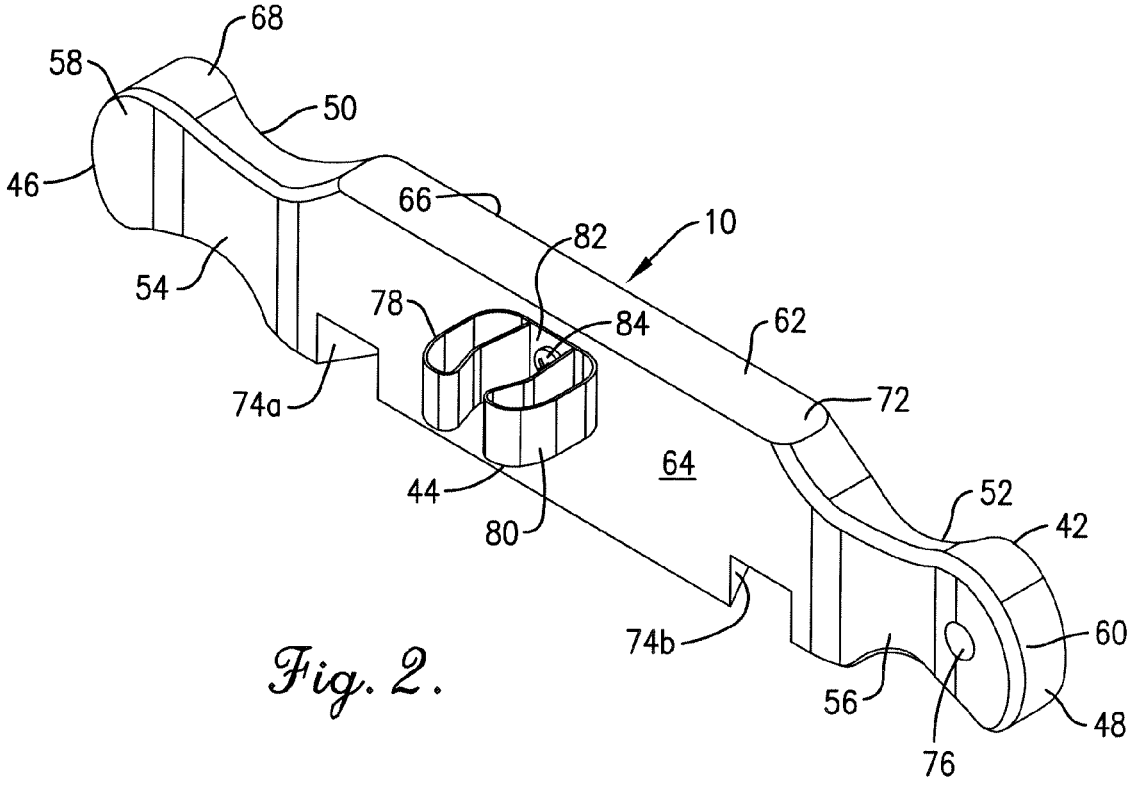
FIG. 2 is a top perspective view of the paint brush holder depicted in FIG. 1, particularly illustrating the lid-engaging surface.

As perhaps best shown in FIGS. 1 and 2, the brush holder 10 generally includes a body 42 and a handle-gripping element 44. Preferably, the brush holder 10 is designed to removably attach to the can 12 and support the brush 11 on the can 10 so that the applicator 40 is adjustably positioned within the chamber 18.

The body 42 is formed of any suitable material (e.g., wood, plastic, metal, etc.) and presents a pair of ends 46 and 48. Handles 50 and 52 defined adjacent the ends 46 and 48 each include a neck section 54 and 56 and an outermost end section 58 and 60, respectively. It is particularly noted that each of the neck sections has a reduced cross-sectional dimension relative to the respective end section to provide comfortable gripping of the body 42. Although the illustrated handles 50 and 52 are generally similar in shape and size, the principles of the present invention are equally applicable to a brush holder having different handles. A central section 62 extends between the neck sections 54 and 56.

The sections 54-62 cooperatively define opposite front and back faces 64 and 66 and a side face 68 that extends between the faces 64 and 66 about the periphery of the body 42. The front and back faces 64 and 66 are preferably parallel relative to one another and flat. The side face 68 presents a curvilinear shape at the handles 50 and 52, but it is otherwise generally straight to present a can-engaging surface 70 and an opposite lid-engaging surface 72. A pair of can-receiving groove sections 74*a* and 74*b* are spaced along the can-engaging surface 70. The illustrated body 42 has a generally linear shape and a generally rectangular cross-section, particularly along the central section 62. The illustrated body 42 has an approximate length of about twelve (12) inches, a height of about two (2) inches, and a width (except in the neck sections 54 and 56) of about three-quarter (¾) of an inch. However, it is entirely within the ambit of the present invention to utilize other body shapes and sizes (e.g., an arcuate shaped body).

In particular, each of the illustrated can-receiving groove sections consists of a recess extending inwardly from the can-engaging surface. The groove sections preferably have a rectangular cross-sectional shape. The illustrated groove sections 74*a* and 74*b* cooperatively define an acute angle therebetween and are positioned to receive spaced apart sections of the top of a paint container. Most preferably, the angle defined by the sections 74*a* and 74*b* is about sixty degrees (60°) and the minimum distance therebetween (measured along the back face 64) is approximately three and three-quarter (3¾) inches. It has been determined that such a configuration fits both the illustrated one-gallon can 12 and other container sizes, e.g., two and one-half or five gallon buckets (for five gallon buckets and larger sizes, the overall length and other dimensions will need to be increased accordingly). The groove sections 74*a* and 74*b* preferably have a minimum depth of at least about one-quarter (¼) of an inch. Such a dimension is believed critical to ensure secure attachment of the body 42 to the can 12. Specifically, each of the groove sections preferably has a depth of approximately nine-sixteenths (9/16) of an inch and a width of approximately five-eighths (5/8) of an inch. Moreover, the preferred configuration of the groove sections 74*a* and 74*b* causes the rim 24 and the top of the side wall 22 to be "wedged" therein, such that the holder 10 is securely attached to the can 12. Furthermore, the illustrated configuration causes the holder 10 to be located substantially off center of the can 12 to prevent interference with the handle 32 and use of the brush 11.

A hole 76 extends through the handle 52 between the faces 64 and 66. The hole 76 preferably has a diameter of about three-eighths (3/8) of an inch and is provided so that the holder 10 may be conveniently hung when not in use.

The illustrated handle-gripping element 44 is preferably secured against the front face 64 at a location spaced equally between the ends 46 and 48, although other locations on the body 42 are entirely within the ambit of the present invention. Moreover, the principles of the present invention are equally applicable to a brush holder having multiple gripping elements. The illustrated gripping element 44 includes a pair of flexible arms 78 and 80 projecting outwardly from a back plate 82. A screw 84 extends through the back plate 82 and serves to fix the gripping element 44 to the body 42, although other suitable fasteners or attachment means may be used to interconnect the body 42 and gripping element 44. In fact, the present invention contemplates integrally forming the body 42 and gripping element 44 as a single unit (e.g., utilizing a synthetic resin molding technique). The preferred gripping element 44 comprises a metal clip formed of spring steel, although other materials may be used. A suitable metal clip is available under the designation "MEDIUM GRIP CLIP ORGANIZER," Item No. 13201, from The Lehigh Group of Macungie, Pa. 18062.

The gripping element 44 is preferably configured to exert a gripping force against the handle 34 of the brush 11. In particular, the arms 78 and 80 are resiliently flexed apart when the handle 34 is located therebetween, whereby the arms grip the handle 34 and hold brush 11 in the desired position. If the holder 10 is used with a brush having a handle of varying shape, the gripping element is configured to accommodate the different cross-sectional sizes of the handle. In the illustrated embodiment, the brush handle 34 is preferably "snapped" between the arms 78 and 80 and slid against the frictional engagement of the element 44 to the desired position.

Alternative gripping elements may be used. For example, the principles of the present invention are equally applicable to a elastomeric ring (not shown) in which the brush handle 34 is received. One suitable arrangement involves retaining the ring in a rigid sleeve (also not shown), such that the ring is elastically compressed when the handle is received therein. The ring may alternatively be arranged to elastically stretch when the brush handle is received therein. In view of the foregoing, flexibility of the gripping element shall not be interpreted to mean only elastic bending of the illustrated arms 78 and 80, but rather resilient flexing of the gripping element should constitute any elastic deformation that causes a gripping force to be exerted against the handle when it is gripped.

Figure 6:
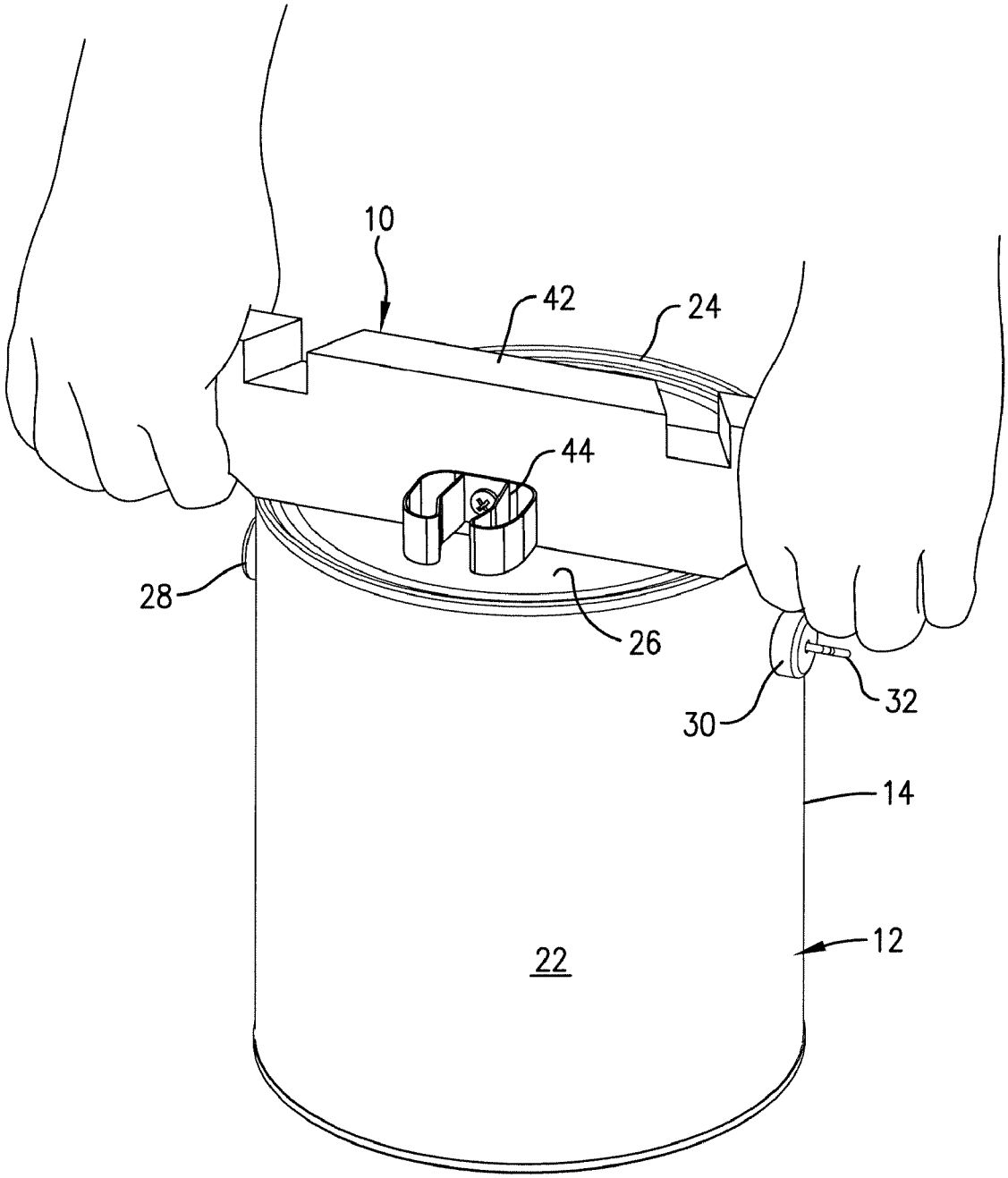
FIG. 6 is a perspective view of the paint brush holder being used to secure a lid on the paint can.

In use, the brush holder 10 is securely but removably attached to the can 12 by receiving portions of the side wall 22 and rim 24 in the groove sections 74*a* and 74*b*. The brush 11 is preferably then coupled to the can 12, with the applicator 40 located in the chamber 18, by snapping the brush handle 34 into the gripping element 44. If desired, the brush 11 may be attached to the holder 10 before the latter is secured to the can 12. As perhaps best shown in FIGS. 3 and 4, the brush holder 10 serves to hold the brush 11 in different vertically spaced locations relative to the can 12. Repositioning of the brush 11 relative to the can 12 can occur by wholly removing the brush handle 34 from the gripping element 44, moving the brush 11 to the desired location, and then snapping the handle back into the gripping element 44. Alternatively, the brush handle 34 may simply be slid against the frictional engagement of the element 44 to the desired position. As shown in FIG. 6, the flat lid-engaging surface 72 is particularly useful in reattaching the lid 26 to the rim 24.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A paint brush holder for supporting a paint brush on an open top paint container having an upright container wall, wherein the paint brush has an elongated handle and a paint applicator projecting from one end of the handle, said paint brush holder comprising:

a body removably attachable to the paint container, said body presenting spaced apart first and second upright surfaces, said body presenting a pair of spaced apart, discrete, container-receiving grooves, each of the grooves comprising an inwardly extending recess defined in the body and configured to receive a section of the container wall therein, each of said grooves extending generally linearly through the body and intersecting the upright surfaces of the body, with a first length dimension being defined along the first upright surface between the groove intersections, and a second length dimension being defined along the second upright surface between the groove intersections, said first length dimension being greater than said second length dimension, such that the pair of grooves cooperatively define an acute angle therebetween as measured along a generally horizontal plane, with the grooves thereby being configured to simultaneously receive the respective container wall sections therein; and a handle gripping element fixed to the body so as to be disposed in lateral alignment with the open top of the container when the body is attached to the container, said gripping element being configured to releasably grip the handle of the paint brush along the length of the handle, with the applicator thereby being moveably located within the paint container at a position that is vertically adjustable relative to the open top of the container.

2. The paint brush holder as claimed in claim 1, said body presenting a pair of opposite ends, with handles being defined adjacent the ends.

3. The paint brush holder as claimed in claim 2, said gripping element being spaced equally between the ends.

4. The paint brush holder as claimed in claim 2, each of said handles including a neck section and an outermost end section, with the neck section having a reduced cross-sectional dimension relative to the end section.

5. The paint brush holder as claimed in claim 2, said body defining a lid-engaging surface extending between the handles, said lid-engaging surface being dimensioned to at least substantially span a segment of the top of the paint container.

6. The paint brush holder as claimed in claim 5, said lid-engaging surface being generally flat.

7. The paint brush holder as claimed in claim 1, said angle being about 60 degrees.

8. The paint brush holder as claimed in claim 1, said grooves presenting a depth of at least about ¼ of an inch.

9. The paint brush holder as claimed in claim 1, said gripping element being configured to resiliently flex when the handle is gripped so as to exert a gripping force against the handle.

10. The paint brush holder as claimed in claim 9, said gripping element including a pair of spaced apart arms between which the handle is gripped, said arms being resiliently shiftable away from one another.

11. The paint brush holder as claimed in claim 10, said gripping element being formed of spring steel.

12. In combination:

a paint container including wall structure defining an internal chamber and an open top, said wall structure including an upright wall;

a paint brush including an elongated handle and a paint applicator projecting from one end of the handle; and a paint brush holder removably attached to the wall structure, said brush holder including a handle gripping element releasably gripping the handle so that the applicator is moveably positioned within the chamber at a position that is vertically adjustable relative to the open top, said paint brush holder including a body on which the gripping element is fixed, said body being removably attached to the wall structure, said body presenting spaced apart first and second upright surfaces, said body presenting a pair of spaced apart, discrete, container-receiving grooves, each of the grooves comprising an inwardly extending recess defined in the body and removably receiving a section of the upright wall therein, each of said grooves extending generally linearly through the body and intersecting the upright surfaces of the body, with a first length dimension being defined along the first upright surface between the groove intersections, and a second length dimension being defined along the second upright surface between the groove intersections, said first length dimension being greater than said second length dimension, such that the pair of grooves cooperatively define an acute angle therebetween as measured along a generally horizontal plane, with the grooves thereby simultaneously receiving the respective upright container wall sections therein.

13. The combination as claimed in claim 12, said wall structure including a bottom wall, a side wall projecting upwardly from the bottom wall, and a rim circumscribing the top of the side wall and defining the open top of the paint container.

14. The combination as claimed in claim 13, said sidewall being cylindrical in shape, with the rim presenting a circular open top.

15. The combination as claimed in claim 12, said body presenting a pair of opposite ends, with handles being defined adjacent the ends.

16. The combination as claimed in claim 15, said gripping element being spaced equally between the ends.

17. The combination as claimed in claim 15, each of said handles including a neck section and an outermost end section, with the neck section having a reduced cross-sectional dimension relative to the end section.

18. The combination as claimed in claim 15; and a lid removably attachable to the paint container in a covering relationship with the open top, said body defining a lid-engaging surface extending between the handles, said lid-engaging surface being dimensioned to at least substantially span a segment of the top of the paint container.

19. The combination as claimed in claim 18, said lid-engaging surface being generally flat.

20. The combination as claimed in claim 12, said angle being about 60 degrees.

21. The combination as claimed in claim 12, said grooves presenting a depth of at least about ¼ of an inch.

22. The combination as claimed in claim 12, said gripping element being configured to resiliently flex when the handle is gripped so as to exert a gripping force against the handle.

23. The combination as claimed in claim 22, said gripping element including a pair of spaced apart arms between which the handle is gripped, said arms being resiliently shiftable away from one another.

24. The combination as claimed in claim 23, said gripping element being formed of spring steel.

25. The paint brush holder as claimed in claim 1, each of said grooves being defined by a recessed wall, at least portions of the recessed walls of the grooves defining the acute angle therebetween.

26. The paint brush holder as claimed in claim 25, each recess wall presenting a pair of side wall sections and a base wall section, said pair of side wall sections being substantially parallel to one another, said base wall section being substantially orthogonal to said side wall sections.

27. The combination as claimed in claim 12, each of said grooves being defined by a recessed wall, at least portions of the recessed walls of the grooves defining the acute angle therebetween.

28. The combination as claimed in claim 27, each recess wall presenting a pair of side wall sections and a base wall section, said pair of side wall sections being substantially parallel to one another, said base wall section being substantially orthogonal to said side wall sections.

* * * * *